United States Patent [19]

Makita

[11] Patent Number: 4,692,045

[45] Date of Patent: Sep. 8, 1987

[54] PRINTING APPARATUS CAPABLE OF CORRECTING PRINTED CHARACTERS BY OFFSET PRINTS

[75] Inventor: Masaru Makita, Tokyo, Japan

[73] Assignee: Canon Kabushiki Kaisha, Tokyo, Japan

[21] Appl. No.: 728,461

[22] Filed: May 1, 1985

Related U.S. Application Data

[63] Continuation of Ser. No. 473,205, Mar. 8, 1983, abandoned.

[30] Foreign Application Priority Data

Mar. 19, 1982 [JP] Japan ..... 57-42947

[51] Int. Cl.[4] ..... B41J 11/36

[52] U.S. Cl. ..... 400/697; 400/144.2; 400/210; 400/304; 400/903

[58] Field of Search ..... 400/144.2, 210, 304, 400/696, 697, 697.1, 903

[56] References Cited

U.S. PATENT DOCUMENTS

| | | | |
|---|---|---|---|
| 4,114,750 | 9/1978 | Baeck et al. | 400/903 X |
| 4,176,977 | 12/1979 | Shepard, Jr. | 400/903 X |
| 4,286,889 | 9/1981 | Ebert et al. | 400/697.1 |
| 4,307,971 | 12/1981 | Kane, III et al. | 400/304 X |
| 4,311,398 | 1/1982 | Gerjets | 400/144.2 X |
| 4,388,005 | 6/1983 | Wehking et al. | 400/697 X |

FOREIGN PATENT DOCUMENTS

| | | | |
|---|---|---|---|
| 0063675 | 5/1981 | Japan | 400/210 |
| 0136370 | 10/1981 | Japan | 400/210 |
| 0160180 | 9/1983 | Japan | 400/697 |
| 0160181 | 9/1983 | Japan | 400/697 |
| 0160182 | 9/1983 | Japan | 400/697 |
| 0158279 | 9/1984 | Japan | 400/697 |
| 2138746 | 10/1984 | United Kingdom | 400/697 |

*Primary Examiner*—Ernest T. Wright, Jr.

*Attorney, Agent, or Firm*—Fitzpatrick, Cella, Harper & Scinto

[57] ABSTRACT

There is disclosed a printing apparatus provided with a mechanism for erasing printed characters by actuating a type font through an erasing ribbon and a mechanism for selecting characters by rotating the type font, wherein the erasure of a printed character is achieved by rotating a type selected from said type font by a determined amount for printing a character in the overlapping manner on the character to be erased.

9 Claims, 8 Drawing Figures

PRINTING APPARATUS CAPABLE OF CORRECTING PRINTED CHARACTERS BY OFFSET PRINTS

This application is a continuation of application Ser. No. 473,205 filed Mar. 8, 1983, now abandoned.

BACKGROUND OF THE INVENTION

1. Field of the Invention

The present invention relates to a printing apparatus, and more particularly to an impact printing apparatus provided with a mechanism for erasing or correcting printed characters through an erasing ribbon.

2. Description of the Prior Art

In a conventional typewriter or the like, the erasure of a printed character is achieved by moving the printing head to the character to be erased and striking the same character through an erasing ribbon. The erasing ribbon may be composed of an adhesive tape for lifting off the printed ink from the printing sheet, or of a tape coated with a material of a color the same as that of the printing sheet for covering the character to be erased.

In such conventional printing apparatus with a so-called overlap typing mechanism for erasure, incomplete erasure has often been observed because the carriage moving mechanism is not precise enough for printing the same character again exactly on the previously printed character and can only stop the carriage in a slightly different position. Such an incompletely erased character smears a character newly printed thereon, thus providing an extremely undesirable finish.

Such overlap typing correction, if to be made complete through improved precision of the mechanism, will lead to a significantly higher manufacturing cost. Also U.S. Pat. No. 4,307,971 discloses a mechanism for achieving such overlap typing through a slight movement of the carriage, but a precise function is difficult to achieve in practice in consideration of the large weight of the carriage.

SUMMARY OF THE INVENTION

In consideration of the foregoing, the object of the present invention is to provide a printing apparatus, adapted for use in a typewriter or the like, provided with an erasing mechanism capable of exactly erasing a previously printed character with a simple mechanism employing the rotation of a typefont wheel instead of the carriage movement as disclosed in the aforementioned U.S. Patent.

DETAILED DESCRIPTION OF THE PREFERRED EMBODIMENTS

Now the present invention will be clarified in detail by preferred embodiments thereof shown in the attached drawing.

FIGS. 1 to 4 illustrate an embodiment of the printing apparatus of the present invention, wherein the same or equivalent components are represented by common reference numbers.

Figure 1:
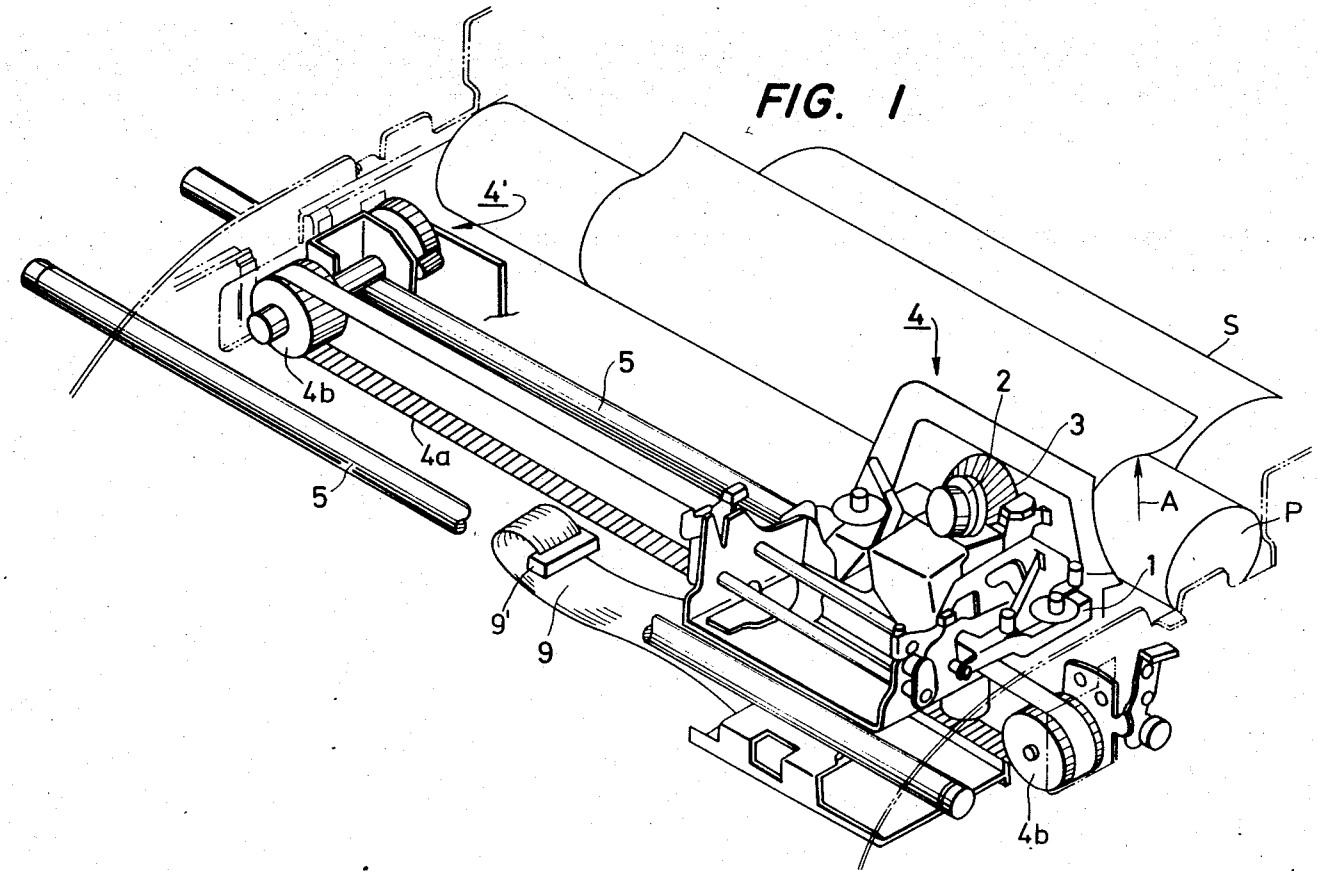
FIG. 1 is a perspective view showing the mechanical structure of an embodiment of the present invention.

FIG. 1 illustrates the mechanical structure of the printing apparatus of the present invention, wherein a carriage 4 carries a typefont wheel 3 made of a flexible material such as plastic and a typing hammer device 2 positioned behind said typefont wheel 3. Also there is provided a ribbon shifting mechanism 1 for positioning a typing ribbon 6 (FIG. 2) and an erasing ribbon 7 (FIG. 2) between said typefont wheel 3 and a typing sheet S supported by a platen P.

Figure 2:
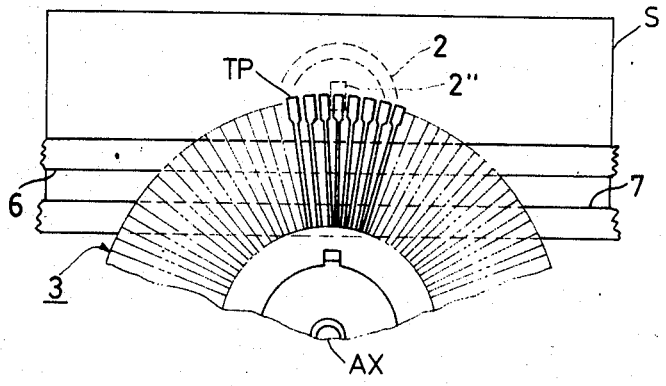
FIG. 2 is a schematic view showing the mechanical structure of an embodiment of the present invention.

FIG. 2 shows the positional relationship of the typefont wheel 3, typing ribbon 6 and erasing ribbon 7 in the non-printing state. In the typing or erasing operation, the typing ribbon 6 or erasing ribbon 7 is respectively shifted upwards, as indicated by an arrow A in FIG. 1, by the aforementioned ribbon shifting mechanism 1 to a position between the typefont wheel 3 and the typing sheet S, and the printing or erasing is achieved by striking, with a hammer 2″ provided in the typing hammer device 2, types TP formed on the outer ends of spokes formed on the periphery of the typefont wheel 3.

The carriage 4 provided with the above-described mechanisms is rendered movable by a character space upon each printing or by plural spaces along guides 5, 5 parallel to the platen P, by means of a carriage driven system 4′ composed for example of a belt 4*a* and pulleys 4*b*. In FIG. 1 there are also shown a cable 9 and a connector 9′ for supplying the head carriage 4 with power supply voltage and control signals.

Figure 3:
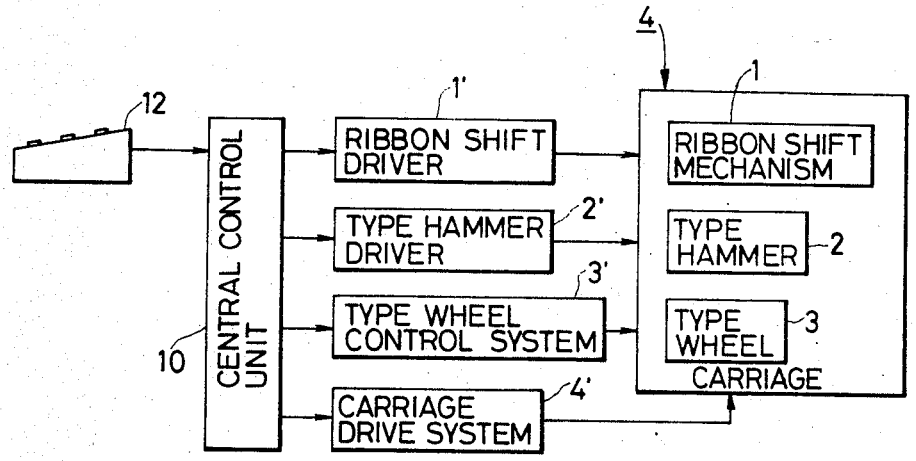
FIGS. 3 and 4 are block diagrams showing an embodiment of the electronic control circuit of the present invention.

FIG. 3 is a block diagram showing an electronic circuit for controlling the above-described mechanisms, in which the same components as those in FIGS. 1 and 2 are represented by the same numbers.

In FIG. 3, a central control unit 10 is connected to a keyboard 12 for receiving the instructions entered through said keyboard 12, and, in response to said instructions, the central control unit 10 controls a typefont wheel control system (WSYS) 3′, a typing hammer driver (HMD) 2′, a ribbon shifting driver (RSD) 1′, and a carriage driving system (CSYS) 4′ to respectively drive the typefont wheel (WL) 3, typing hammer device (HM) 2, ribbon shifting mechanism (RSM) 1 and carriage (CRG) 4.

Figure 4:
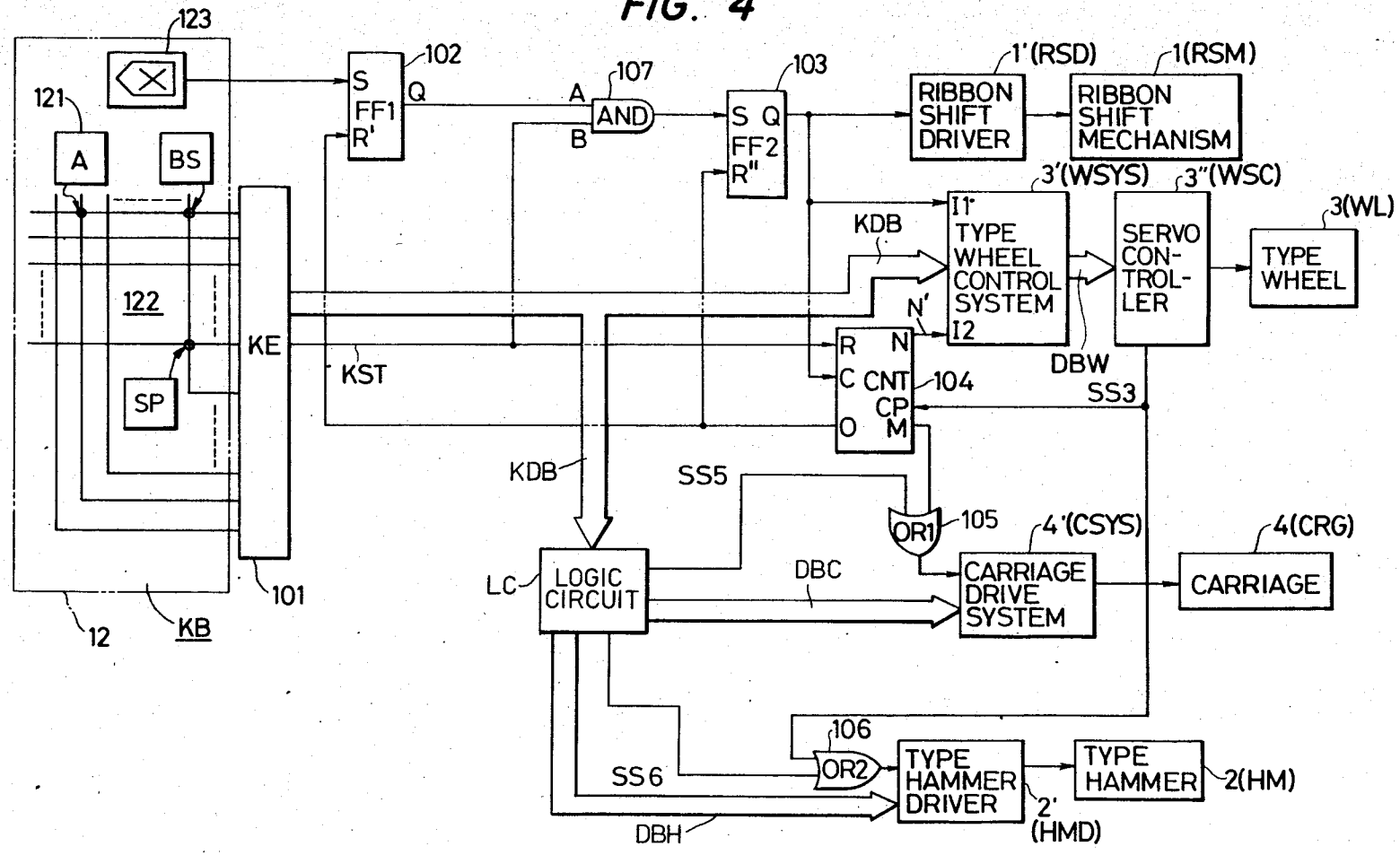

FIG. 4 shows the above-described circuit in more detail with emphasis on the central control unit 10, wherein various blocks of the central control unit 10 shown in FIG. 3 are represented by numbers starting from 101 while the keys and circuits of the keyboard (KB) 12 are represented by numbers starting from 121. The same or equivalent components are represented by the same numbers and explanation of them will be omitted in the following description. The circuit shown in FIG. 4 is in principle the same as that disclosed in the aforementioned U.S. Pat. No. 4,307,971 except that it is applied to the rotational control of the typefont wheel 3 instead of the carriage movement control.

In FIG. 4, the keyboard 12 is provided with alphanumeric keys 121 for typing different characters, for example a letter "A" as illustrated, and an erasure instruction key 123. Actuation of a character key 121 is detected by a key matrix 122, which is connected to a key encoder (KE) 101.

The erasure instruction key 123 is connected to the set port S of an RS flip-flop (FF1) 102, of which output port Q is connected to an input port A of an AND gate 107. The output signal of said AND gate 107 is supplied to the set port S of a similar RS flip-flop (FF2) 103, of which output port Q is connected to the input port of the ribbon shifting driver 1' and to the input port I1 of the typefont wheel control system 3'.

The key encoder (KE) 101 is connected through a data bus KDB to the typefont wheel control system 3' and to a logic circuit LC, and also supplies a key strobe signal KST to an input port B of the AND gate 107 and to the input port R of a counter (CNT) 104.

Said counter 104 receives, through the other input port C, the output signal of the flip-flop 103, and supplies an output discrimination signal N' from the output N port of counter 104 to an input port I2 of the typefont wheel control system 3'. Also an output port M of said counter 104 is connected to an OR gate (OR1) 105 which also receives a signal SS5 from the logic circuit LC and which is in turn connected to the carriage driving system 4'. Still another output port O of said counter 104 is connected to the reset ports R' and R'' of the flip-flops 102, 103 respectively.

The output signal of the typefont wheel control system 3' is supplied through a data bus DBW to a servo controller (WSC) 3'' which supplies a monitor signal SS3, through an OR gate (OR2) 106 also receiving a signal SS6 from the logic circuit LC, to the typing hammer driver 2'. Said output signal SS3 is also supplied to an input port CP of the counter 104.

The carriage driving system 4' and the typing hammer driver 2' are also controlled by the logic circuit LC through data buses DBC, DBH.

Figure 5A:
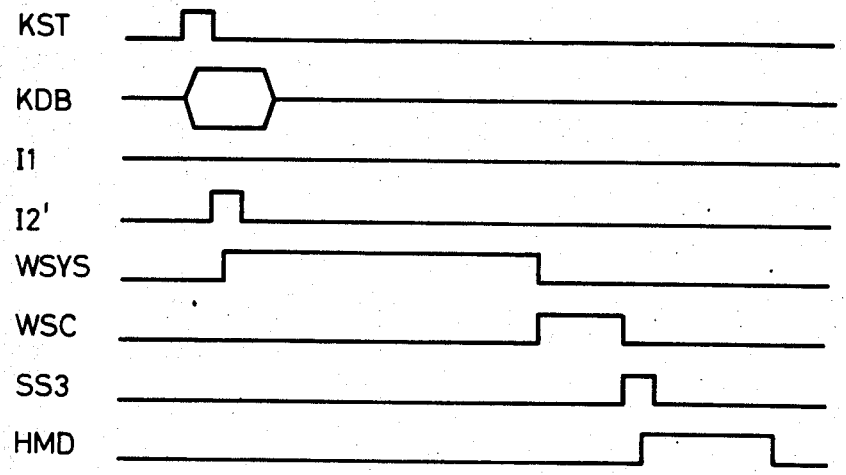
FIGS. 5A and 5B are timing charts showing the control procedure of the electronic control circuit of the present invention.

Now reference is made to FIG. 5A for explaining the procedure of normal typing operation in the above-described circuit.

Normal typing operation is commenced by the actuation of a character key 121, for example "A", of the keyboard 12. The position of the thus actuated key 121 is detected by the key matrix 122 and is converted, by the key encoder 101, into electric signals, which are supplied through the data bus KDB. In case the information on the actuated key 121 is firm, the key encoder 101 simultaneously releases a key strobe signal KST.

In response to said key strobe signal KST, the counter 104 releases the discrimination signal N' to activate the typefont wheel control system 3'. The FIG. 5A, a signal I2' (which is the same as the discrimination signal N') represents the input signal to the input port I2 of the typefont wheel control system 3'. In response to said input signal I2', the typefont wheel control system 3' calculates, from the information sent through the data bus KDB, the rotation angle of the typefont wheel 3 from the present position thereof to the position of the desired character "A", and supplies the result of said calculation to the servo controller 3'' through the data bus DBW.

The servo controller 3'' accordingly rotates the typefont wheel 3, and, when it is stopped, releases the monitor signal SS3 indicating the completion of the character selection.

The monitor signal SS3 opens the OR gate 106 to activate the typing hammer driver 2', whereby the typing hammer device 2 performs the printing operation with an impact force appropriate for the selected character, according to the information supplied from the logic circuit LC through the data bus DBH. In FIG. 5A, a signal HMD indicates the output signal of the typing hammer driver 2'.

In this manner there is achieved a normal printing operation consisting of the steps of character key actuation, character selection and printing.

Figure 5B:
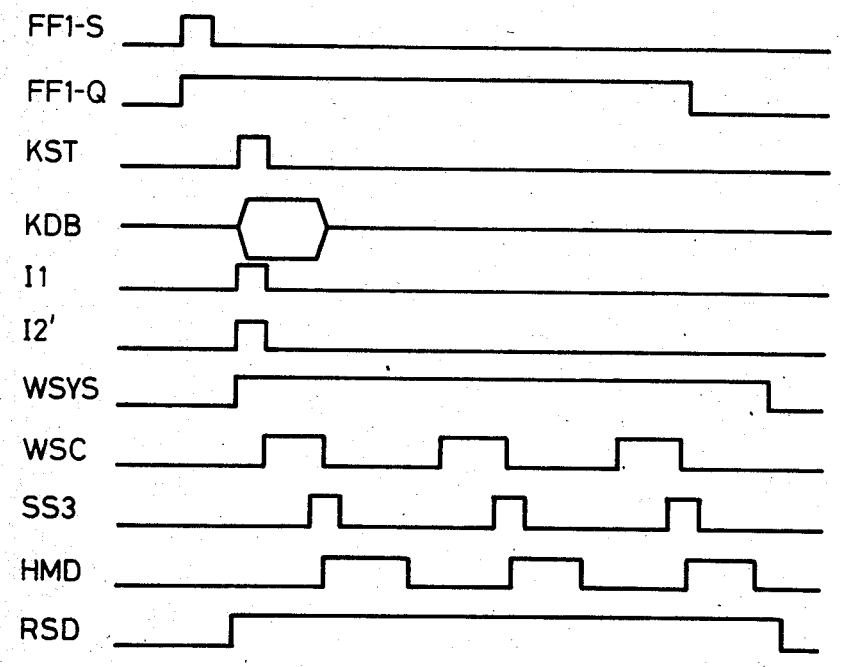

Then reference is made to FIG. 5B, showing the procedure of erasing an already printed character.

In case of erasing a previously printed unnecessary character, the carriage 4 is at first displaced to the position of such unnecessary character by a back space key BS or a space key SP provided in the keyboard 12. Such carriage displacement is controlled by logic signals supplied through the data bus DBC from the logic circuit LC connected to said back space key BS or space key SP and by the signal SS5 for stopping the carriage 4.

Then, in response to the actuation of the erasure instruction key 123, the flip-flop 102 is set to continuously supply a logic signal "1" to the input port A of the AND gate 107. In FIG. 5B, signals FF1-S and FF1-Q indicate the input and output waveforms of the flip-flop 102.

Subsequently a character key 121, for example "A", the same as the unnecessary character to be erased, is actuated on the keyboard 12. In response to said actuation, the key encoder 101 releases the information for character selection through the data bus KDB and the key strobe signal KST in the same manner as in the normal printing operation.

The key strobe signal KST is supplied to the input port B of the AND gate 107 to open the gate 107, whereby the flip-flop 103 is set to activate the ribbon shifting driver 1', whereby the ribbon shifting mechanism 1 lifts the erasing ribbon 7 in the direction of arrow A shown in FIG. 1, thereby enabling the use of said erasing ribbon 7.

The output signal of the flip-flop 103 is supplied to the input port C of the counter 104, thereby opening the OR gate 105 through the counter 104, thus locking the carriage 4 through the carriage driving system 4'. Also the output signal is supplied to the input port I1 of the typefont wheel control system 3'.

Simultaneously the key strobe signal KST is supplied to the input port R of the counter 104 in the same manner as in the normal printing operation, whereby the counter 104 supplies the discrimination signal N' to the typefont wheel control system 3'.

The typefont wheel control system 3' is constructed in such a manner as to perform the erasing operation with a slight displacement of the typefont wheel 3 in response to a pulse signal received at the input port I2, or in response to a logic signal "1" received at the input port I1. Thus, the typefont wheel 3 is at first rotated, in the same manner as in the normal printing operation, by the servo controller 3'' until the type "A" becomes positioned in front of the typing hammer 2'', and a first typing for erasure is achieved by the typing hammer driver 2' in response to the monitor signal SS3 supplied from the servo controller 3'' through the OR gate 106.

Then the typefont wheel control system 3' rotates the typefont wheel 3 by a determined small angle through the servo controller 3'', and a second erasing operation is performed in response to the monitor signal SS3 supplied from the servo controller 3'' in the same manner as explained before.

Subsequently the typefont wheel control system 3' rotates the typefont wheel 3 in the opposite direction by an angle equal to twice of the above-mentioned small angle, and, after a similar erasing operation, returns the typefont wheel 3 to the original position by reversing said wheel 3 by said small angle.

The counter 104 counts the number of the signals SS3, and, upon reception of said signal three times, releases a logic signal "1" from the output port O to reset the flip-flops 102, 103, whereby the ribbon shifting driver 1' is deactivated and the typing ribbon 6 becomes enabled instead of the erasing ribbon 7.

Thereafter a correct character can be printed in the normal printing operation.

As explained in the foregoing, the typing operation with the erasing ribbon 7 is repeated three times, at first exactly on the unnecessary character "A", then at a position slightly moved to a side through a small rotation of the typefont wheel 3, and finally at a position at the other side with corresponding rotation of the typefont wheel 3. As explained before, the erasing ribbon 7 continues to be shifted upwards during the above-described erasing steps.

If the ratio of the vertical length of a type TP (FIG. 2) to the distance between the rotary axis AX (FIG. 2) of the typefont wheel 3 and the outer periphery thereof is on the order of 1:12 as is usually found in such wheel 3, the ratio of amounts of displacement of a character between the upper and lower end thereof is approximately 12:11. Consequently the type TP performs an approximately parallel displacement by the rotation of a small angle of the typefont wheel 3.

Figure 6:
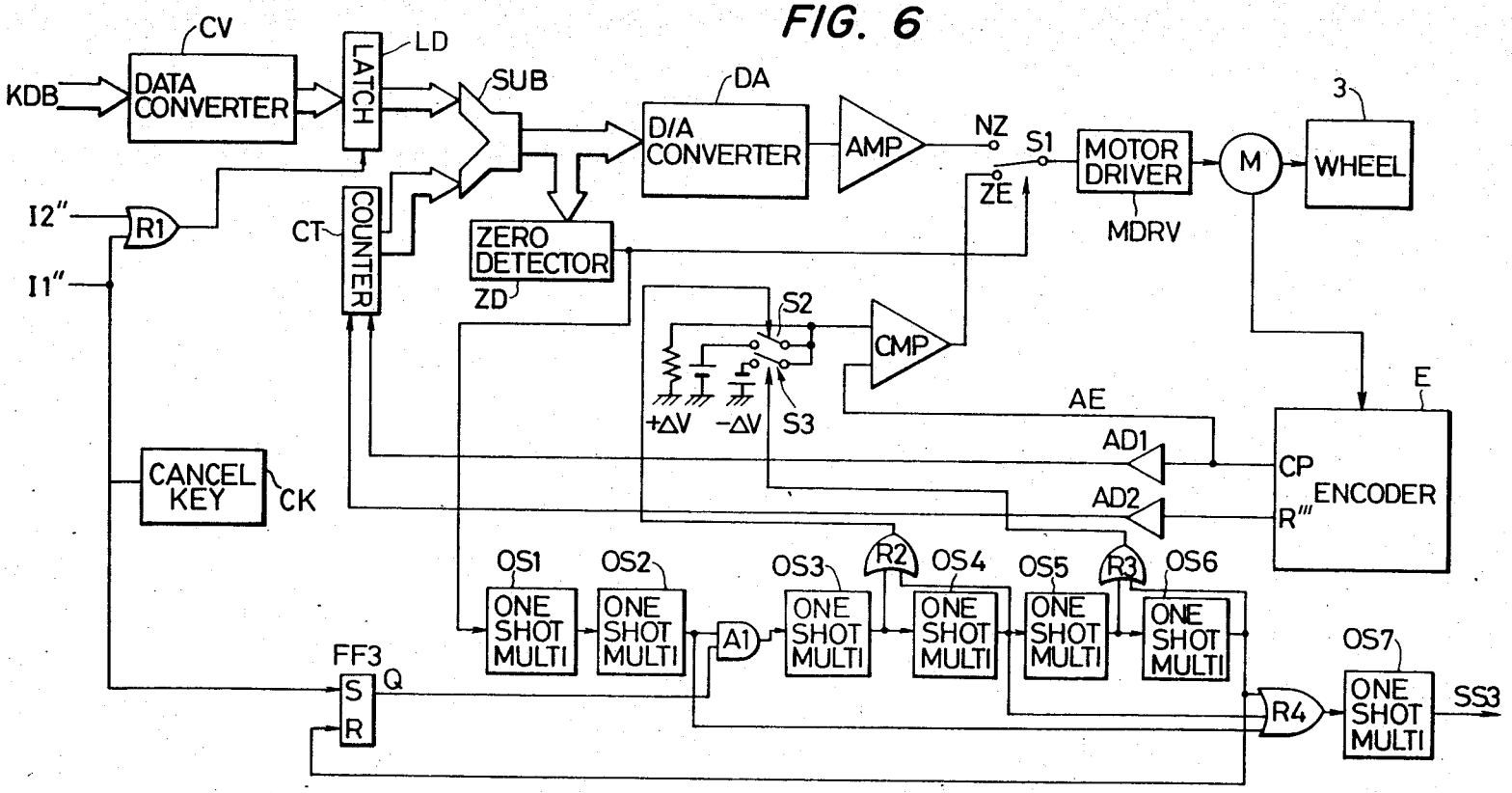
FIG. 6 is a circuit diagram showing an embodiment of the present invention.
Figure 7:
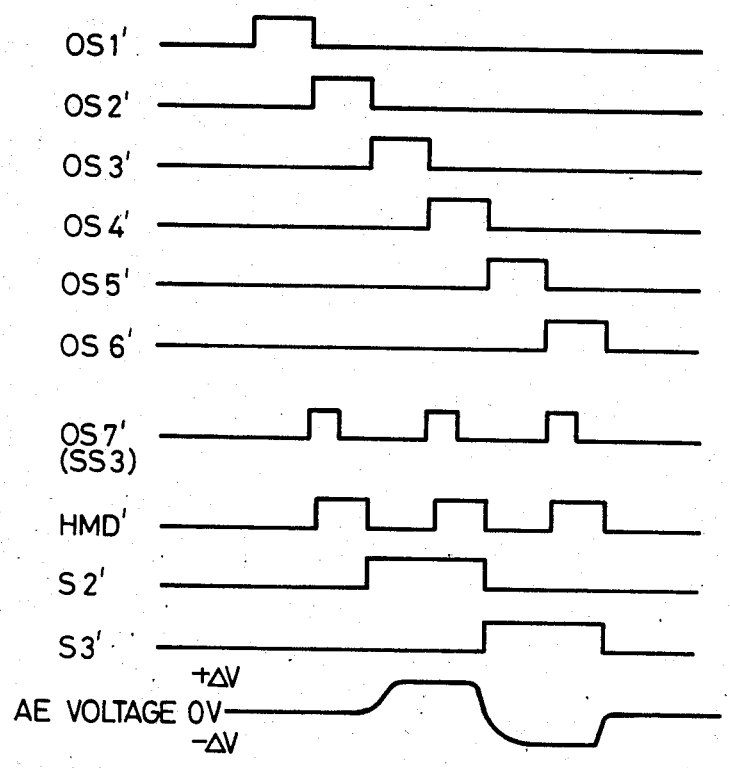
FIG. 7 is a timing chart showing the function of said circuit.

FIG. 6 shows a detailed circuit diagram of another embodiment of the present invention, and FIG. 7 is a corresponding waveform chart. In FIG. 6, the information entered from the keyboard 12 is supplied through the data bus KDB to a data converter CV, and information indicating a desired character in the form of an address on the typefont wheel 3 is stored in a latch LD, in response to the entry of a key actuation signal I1" or I2". The content of a counter CT indicating the rotational position of the typefont wheel 3 and the above-mentioned information stored in said latch LD are compared in subtractor SUB, and the result of said subtraction is supplied to a D/A converter DA and a zero detector ZD. The output signal of said zero detector ZD is supplied to a switch S1 for connecting said switch S1 to a terminal ZE or NZ respectively depending on whether or not the above-mentioned rotational position of the wheel 3 and the information stored in the latch LD coincide. Thus, in case the typefont wheel 3 is not positioned at the desired type, the output signal from said D/A converter DA is supplied, through an amplifier AMP, to a motor driver MDRV as a signal indicating the amount of needed rotation of the typefont wheel 3. The motor driver MDRV activates a servo motor M for rotating the typefont wheel 3. An encoder E provided on the motor M generates signals AE for counting the motor revolution from an output port CP, and a reset pulse from R'''output port upon each turn of the typefont wheel 3. These signals are supplied, through A/D converters AD1, AD2, to the counter CT. The selection of the characters on the typefont wheel 3 can be achieved in this manner.

Also the output signal from the zero detector ZD is supplied to a one-shot multivibrator OS1, which activates a one-shot multivibrator OS2 to supply an output signal to an OR gate R4, whereby a one-shot multivibrator OS7 is activated when a desired type on the typefont wheel 3 arrives at a correct position, thus activating the hammer driver HMD and performing the typing operation. In case the signal I1" assumes the high-level state in response to the actuation of a cancel key (ck) on the keyboard 12, the output signal Q of a flip-flop FF3 is turned on after a typing operation according to the above-described sequence, whereby an AND gate A1 is opened to activate a one-shot multivibrator OS3, and a one-shot multivibrator OS4 is activated after a determined period. The signals from said multivibrators OS3, OS4 open an OR gate R2, thus closing a switch S2 and supplying a voltage $+\Delta V$ to a comparator CMP. In this manner the typefont wheel 3 is rotated in a positive direction by a small amount. In this state a second typing operation is carried out since the output signal of the one-shot multivibrator OS4 is supplied to the OR gate R4. Thereafter the one-shot multivibrators OS5, OS6 open an OR gate R3 to close a switch S3, whereby a voltage $-\Delta V$ is supplied to the motor driver MDRV for rotating the typefont wheel 3 in an opposite negative direction by a small amount for effecting the third typing operation. FIG. 7 illustrates the sequence in which signals OS1', OS2', OS3', OS4', OS5', OS6', OS7', HMD', S2' and S3' are generated by elements OS1, OS2, OS3, OS4, OS5, OS6, OS7, HMD, S2 and S3, respectively.

The structure of the present invention explained in the foregoing provides the following advantages.

First the noise resulting from the typing operation is significantly reduced since the erasing ribbon 7 continues to be shifted upwards throughout the entire period of sequential erasing operations. Also incomplete erasure resulting from incorrect positioning of the carriage 4 can be completely avoided, since the typing operation with the erasing ribbon 7 is followed by two additional typing operations with the erasing ribbon 7, with slight rotations of the typefont wheel 3 on both sides of the unnecessary character. Consequently the functional precision of the carriage 4 need not be very high. In this manner the present invention provides a printing apparatus with a relatively low manufacturing cost that is still capable of achieving a satisfactory finish after correction.

What I claim is:

1. A printing apparatus for printing on a printing sheet, said apparatus comprising:

a carriage movable along a printing sheet;

printing means drivable for printing indicia on a printing sheet and mounted on said carriage for movement therewith; and control means for controlling both the position and drive of said printing means, said control means being operable in an erasing mode for controlling the position of said printing means, at one stationary position of said carriage, to stop at a central position, at a first position which is slightly displaced away from the central position, and at a second position which is slightly displaced away from the central position in a direction opposite to displacement of said printing means from the central position to the first position, said control means further controlling said printing means to be driven at the central position, the first position and the second position, respectively, for erasing on printed indicia.

2. A printing apparatus according to claim 1 wherein said printing means includes a daisy type wheel.

3. A printing apparatus according to claim 1 wherein said printing means includes an erasing ribbon.

4. A printing apparatus according to claim 1 wherein said printing means includes hammer drive means.

5. A printing apparatus according to claim 1 wherein said first, second and central positions are arranged in such a relationship that said central position is centered, and said first and second positions are located at one side and an opposite side of said central position, respectively.

6. A printing apparatus according to claim 5, wherein said printing means is controlled by said control means to be driven first at said central position.

7. A printing apparatus according to claim 1, wherein said control means includes a counter which counts drive of said printing means three times in said erasing mode and thereafter discontinues operation in said erasing mode.

8. A printing apparatus for printing on a printing sheet, said apparatus comprising:

printing means movable in a transverse direction to a plurality of positions for printing a sequence of indicia on a printing sheet and including a type unit having a plurality of type elements mounted for rotation at each transverse position of said printing means and drivable to print the indicia; and control means for controlling both the position and drive of said printing means, said control means being operable in an erasing mode for controlling said type unit, at one position of said printing means in the transverse direction, to stop at a central position, at a first position which is slightly rotated from the central position, and at a second position which is slightly rotated from the central position in a direction opposite to rotation of said type unit from the central position to the first position, said control means further controlling a type element of said type unit to be driven at the central position, the first position and the second position, respectively, for erasing on printed indicia.

9. A printing apparatus according to claim 8, wherein said printing means includes a carriage mounted for said transverse movement and wherein said type unit is a daisy type wheel mounted on said carriage.

* * * * *

UNITED STATES PATENT AND TRADEMARK OFFICE

CERTIFICATE OF CORRECTION

PATENT NO. : 4,692,045

DATED : September 8, 1987

INVENTOR(S) : MASARU MAKITA

It is certified that error appears in the above-identified patent and that said Letters Patent is hereby corrected as shown below:

COLUMN 2

Line 34, "driven" should read --driving--.

COLUMN 3

Line 20, "N port" should read --port N--.

COLUMN 5

Line 60, "R''' output port" should read --output port R'''--.

COLUMN 6

Line 6, "(ck)" should read --(CK)--.
Line 67, "1 wherein" should read --1, wherein--.

UNITED STATES PATENT AND TRADEMARK OFFICE

CERTIFICATE OF CORRECTION

PATENT NO. : 4,692,045

DATED : September 8, 1987

INVENTOR(S) : MASARU MAKITA

It is certified that error appears in the above-identified patent and that said Letters Patent is hereby corrected as shown below:

COLUMN 7

Line 1, "1 wherein" should read --1, wherein--.
Line 3, "1 wherein" should read --1, wherein--.
Line 5, "1 wherein" should read --1, wherein--.

Signed and Sealed this

Second Day of February, 1988

*Attest:*

DONALD J. QUIGG

*Attesting Officer*

*Commissioner of Patents and Trademarks*